US010711802B2

(12) United States Patent
Hambe et al.

(10) Patent No.: US 10,711,802 B2
(45) Date of Patent: Jul. 14, 2020

(54) PUMP MONITORING

(71) Applicant: Weir Minerals Australia Ltd, Artarmon NSW (AU)

(72) Inventors: Michael Hambe, Artarmon (AU); Craig Donald Strudwicke, Molong (AU); Benjamin Michael Baker, Roseville (AU)

(73) Assignee: Weir Minerals Australia Ltd. (AU)

( * ) Notice: Subject to any disclaimer, the term of this patent is extended or adjusted under 35 U.S.C. 154(b) by 58 days.

(21) Appl. No.: 16/301,631

(22) PCT Filed: May 16, 2017

(86) PCT No.: PCT/AU2017/050450

§ 371 (c)(1),
(2) Date: Nov. 14, 2018

(87) PCT Pub. No.: WO2017/197450

PCT Pub. Date: Nov. 23, 2017

(65) Prior Publication Data

US 2019/0203736 A1 Jul. 4, 2019

(30) Foreign Application Priority Data

May 16, 2016 (AU) ..... 2016901804

(51) Int. Cl.
*F04D 29/66* (2006.01)
*F04D 15/00* (2006.01)
(Continued)

(52) U.S. Cl.
CPC ..... *F04D 29/66* (2013.01); *F04D 15/0088* (2013.01); *F04D 17/08* (2013.01); *F04D 29/445* (2013.01)

(58) Field of Classification Search
CPC ..... F04D 29/669; F04D 29/4293; F04D 29/4286; F04D 29/426
See application file for complete search history.

(56) References Cited

U.S. PATENT DOCUMENTS 6,655,922 B1 * 12/2003 Flek ..... F04D 15/0209 417/43
7,309,036 B2 * 12/2007 Crossley ..... D21D 1/002 241/261.2
(Continued)

FOREIGN PATENT DOCUMENTS

CN 201251506 Y 6/2009
CN 102996119 A 3/2013
(Continued)

*Primary Examiner* — Ninh H. Nguyen
(74) *Attorney, Agent, or Firm* — Morriss O'Bryant; Compagni Cannon, PLC.

(57) ABSTRACT

Disclosed is a pump system comprising a pump and a sensor. The pump comprises a pump casing defining a pump chamber, an inlet for receipt of flowable material into the chamber, an outlet for discharge of flowable material from the chamber, and an impeller disposed within the pump chamber to accelerate flowable material within the pump chamber. The pump also comprises a transition region extending between an inner peripheral surface of the pump chamber and an inner peripheral surface of the outlet, the transition region configured in use to divert flowable material accelerated by the impeller to the outlet. The vibration sensor is mounted to the pump casing and arranged in use to detect vibration of the transition region.

20 Claims, 7 Drawing Sheets

(51) Int. Cl.
*F04D 29/44* (2006.01)
*F04D 17/08* (2006.01)

(56) References Cited

U.S. PATENT DOCUMENTS

| | | | | |
|---|---|---|---|---|
| 7,539,549 | B1 | 5/2009 | Discenzo et al. | |
| 8,554,492 | B2 * | 10/2013 | Ahn | G06F 16/90344 702/20 |
| 9,062,682 | B2 * | 6/2015 | Loose | F04D 15/0088 |
| 9,169,838 | B2 | 10/2015 | Kosters et al. | |
| 9,255,578 | B2 | 2/2016 | Sharpe, Jr. et al. | |
| 2004/0013222 | A1 | 1/2004 | Hikida et al. | |
| 2006/0276949 | A1 | 12/2006 | Beck et al. | |
| 2010/0082275 | A1 | 4/2010 | Borsting et al. | |
| 2015/0122037 | A1 | 5/2015 | Obaia et al. | |

FOREIGN PATENT DOCUMENTS

| | | | |
|---|---|---|---|
| CN | 203259335 | U | 10/2013 |
| GB | 2523116 | A | 8/2015 |
| JP | S61244896 | A | 10/1986 |
| SU | 1247707 | A1 | 7/1986 |
| WO | 2009143232 | A1 | 11/2009 |
| WO | 2010092238 | A1 | 8/2010 |
| WO | 2012062542 | A1 | 5/2012 |
| WO | 2017197449 | A1 | 11/2017 |

* cited by examiner

PUMP MONITORING

TECHNICAL FIELD

This disclosure relates to a system and method for monitoring a pump. The system and method have particular, but not exclusive, use in monitoring slurry pumps.

BACKGROUND ART

Pumps used in various operations, such as minerals processing, chemical, oil and gas, power generation etc. experience constant changes in their condition. This may be in the form of e.g. fluctuations in performance and/or degradation of various components of the pumps.

In regards to performance fluctuations, these may be caused by internal changes to the pump or external (e.g. environmental) changes. Such changes may require modification of various operating parameters of the pump to ensure that the performance of the pump is maintained within a suitable range. For example, a change in the consistency of material being processed by the pump may require an adjustment of flow rate.

Often such pumps operate in highly destructive conditions, whereby components of the pumps may be worn away or pitted due to e.g. cavitation. The degradation of one component can lead to imbalances in the pump that results in accelerated degradation.

Both performance and life of a pump can have a direct impact on the costs of running an operation. If a pump fails it can result in the shutdown of an entire process. Similarly, pumps running at sub-optimal performance levels can result in an inefficient process that consumes more energy than required. As such, there is a need to monitor these conditions of a pump.

One known method of doing this is to have an operator observe the pump in person. The operator may view and listen to the pump, and may take various measurements of parameters of the pump. Based on experience working with such pump, the operator may be able to provide an estimate of how the pump is performing, and whether the pump, or one of its components, requires replacement.

Such a method of monitoring pumps relies on the operator's experience, and may ignore many operating parameters of the pumps that are not readily available for measurement by the operator. This may lead to inaccuracies in the estimates made by the operator.

It is to be understood that, if any prior art is referred to herein, such reference does not constitute an admission that the prior art forms a part of the common general knowledge in the art, in Australia or any other country.

SUMMARY

Disclosed is a pump system comprising a pump and a sensor. The pump comprises a pump casing defining a pump chamber, an inlet for receipt of flowable material into the chamber, an outlet for discharge of flowable material from the chamber, and an impeller disposed within the pump chamber to accelerate flowable material within the pump chamber. The pump also comprises a transition region extending between an inner peripheral surface of the pump chamber and an inner peripheral surface of the outlet, the transition region configured in use to divert flowable material accelerated by the impeller to the outlet. The vibration sensor is mounted to the pump casing and arranged in use to detect vibration of the transition region. The pump system further comprises a processor configured to receive vibration data, indicative of vibration at the transition region, from the vibration sensor. The processor is further configured to process the vibration data to determine (or indicate) a wear or performance condition of the pump.

The transition region can be particularly susceptible to wear due to its function as a diverter of flowable material. For example, a pressure differential can form across the transition region and may fluctuate as the distal ends of the vanes of the impeller pass by. This can cause pressure pulses in the fluid that may result in damage to the transition region. Friction and/or impact between the flowable material and the transition region (as the flowable material attempts to recirculate within the pump chamber) can also result in wear. The transition region is also an area of the pump where cavitation can be particularly prevalent. Vibration of the transition region may be in the form of vibration of the entire region, or vibration of a portion of the region, such as isolated vibration of a surface of the region.

Other than this wear, it has become apparent that, because there is a close interaction between the impeller and pump liner or casing at the transition region, vibration of the transition region may be particularly indicative of the condition of the impeller and the pump liner or casing. Hence, vibration data indicative of vibration of the transition region may be used to infer wear, or performance conditions of the pump.

The ability to detect or infer such conditions of the pump may be done without the need for an operator to visually inspect the pump, or be in the vicinity of the pump. Changes in vibration may be used to estimate degradation of the pump and may enable the prediction of when the pump, or components of the pump, may require replacement.

As should be apparent, it is not necessary that the vibration sensor be located directly adjacent the transition region in order to measure vibration indicative of the vibration of the transition region. However, positioning the vibration sensor proximate this region may reduce external (to the transition region) noise in the data and may provide better results.

In one embodiment the outlet may define an internal outlet diameter. The vibration sensor may be mounted to the housing at a distance from the transition region that is less than two outlet diameters. The vibration sensor may be mounted to the housing at a distance from the transition region that is less than one outlet diameter. Such positioning may ensure that the vibration of the transition region can be measured.

In one embodiment the vibration sensor may be an accelerometer.

Accelerometers may be relatively cost-effective and accessible in comparison to other sensors. The accelerometer may be a three-axis accelerometer or a single-axis accelerometer.

In one embodiment a sensing element of the vibration sensor may be oriented so as to sense vibration along an axis that extends generally radially relative to the rotational axis. This may allow the vibration sensor to measure oscillations in the flow of flowable material as it passes across the transition region.

In one embodiment a sensing element of the vibration sensor may be oriented so as to sense vibration along an axis that extends generally circumferentially relative to the rotational axis of the pump.

In one embodiment the vibration sensor may be mounted to an external wall of the pump casing.

In one embodiment the vibration sensor may be at least partially embedded in the pump casing. For example, the vibration sensor may threadedly engaged with the casing (i.e. via a threaded recess).

In one embodiment the pump casing may comprise an internal (and optionally removable) pump liner defining the pump chamber, and the sensor may be mounted so as to be at least partially embedded within the pump liner. Where the internal pump liner is formed of an elastomeric material, the vibration sensor may be e.g. moulded into the pump liner.

In one embodiment the system may further comprise a controller to control the pump in response to the determined wear or performance condition of the pump.

For example, the controller may adjust an operating parameter of the pump, or may cease operation of the pump.

In one embodiment the processor may be configured to perform a spectral analysis on the vibration data. The processor may be configured to determine a wear or performance condition of the pump based on a selection of the vibration data corresponding to the vane pass frequency of the pump. As should be apparent to the skilled person, the vane pass frequency depends on various factors, including the configuration of the impeller and the rotational speed of the impeller. In operation of a pump, as a vane passes the transition region, pressure differences can form in the fluid across the vane (and the transition region). These pressure differences can result in a 'pulse' in the fluid that can manifest with a specific vibration signature (e.g. at the transition region). In some case, the transition region vibrates in response to this pulse. It has become apparent that as the wear or performance conditions of a pump change over time (e.g. impeller, liner, or casing wear), the characteristics of the pulse may change. Hence, by selecting frequencies of the transition region vibration that align with the pulse (i.e. the vane pass frequency), performance or wear conditions of the pump may be determined.

In one embodiment, the processor may be configured to determine a wear or performance condition of the pump based on changes, over time, in the vibration data corresponding to the vane pass frequency of the pump.

In one embodiment the processor may be configured to analyse the vibration data against historical vibration data to classify the vibration data as being representative of a pump having a particular performance or wear condition.

In one embodiment the classification may be performed using a machine learning algorithm. Machine learning algorithms may include, for example, random forest, logistic regression, support vector machine, and/or artificial neural networks. Machine learning algorithms may provide an efficient method for making a prediction of a performance or wear condition based on a large historical data set.

Also disclosed is a method comprising detecting vibration in at least one region of the pump, obtaining vibration data from the measured vibration, the vibration data indicative of the vibration at the transition region of the pump, and analysing the vibration data to determine (or indicate) a wear or performance condition of the pump.

In one embodiment the method may further comprise analysing a predetermined range (or sample) of frequencies of the vibration data to indicate a wear or performance condition of the pump.

In one embodiment the range of frequencies may generally correspond to a vane pass frequency of the pump or a multiple of that vane pass frequency. As set forth above, the vibration at the vane pass frequency (and harmonics of that frequency) may be indicative of the condition of the transition region and/or the vanes of the impeller. A change in the amplitude of vibration at this frequency may be indicative of wear of the inner surface of the pump (e.g. at the transition region) and/or impeller over time.

In one embodiment the sample of frequencies may comprises one or more 10 Hz wide frequency bands comprising the vane pass frequency and/or one or more multiples of the vane pass frequency.

In one embodiment the method may further comprise the step of determining whether the amplitude of the vibration within the predetermined range of frequencies exceeds a predetermined threshold amplitude. The predetermined threshold amplitude may vary between pump and between pump installation. The threshold amplitude may be set based on historical data (e.g. previously measured using the method).

In one embodiment the method may comprise the step of monitoring the predetermined range of frequencies for a change in amplitude over time.

In one embodiment the method may comprise calculating the root mean square of a sample of the vibration data and determining if the calculated root mean square exceeds a predetermined threshold root mean square value.

In one embodiment the wear or performance condition may be wear at the transition region (i.e. cutwater).

In one embodiment the wear or performance condition may be wear of the impeller of the pump.

In one embodiment the wear or performance condition may be a hydraulic condition of the pump.

In one embodiment the vibration may be detected using an accelerometer.

In one embodiment the vibration data may be analysed against historical vibration data to classify the vibration data as being representative of a pump having a particular performance or wear condition.

In one embodiment the classification may be performed using a machine learning algorithm.

BRIEF DESCRIPTION OF THE DRAWINGS

Embodiments will now be described by way of example only, with reference to the accompanying drawings in which.

DETAILED DESCRIPTION

Figure 1B:
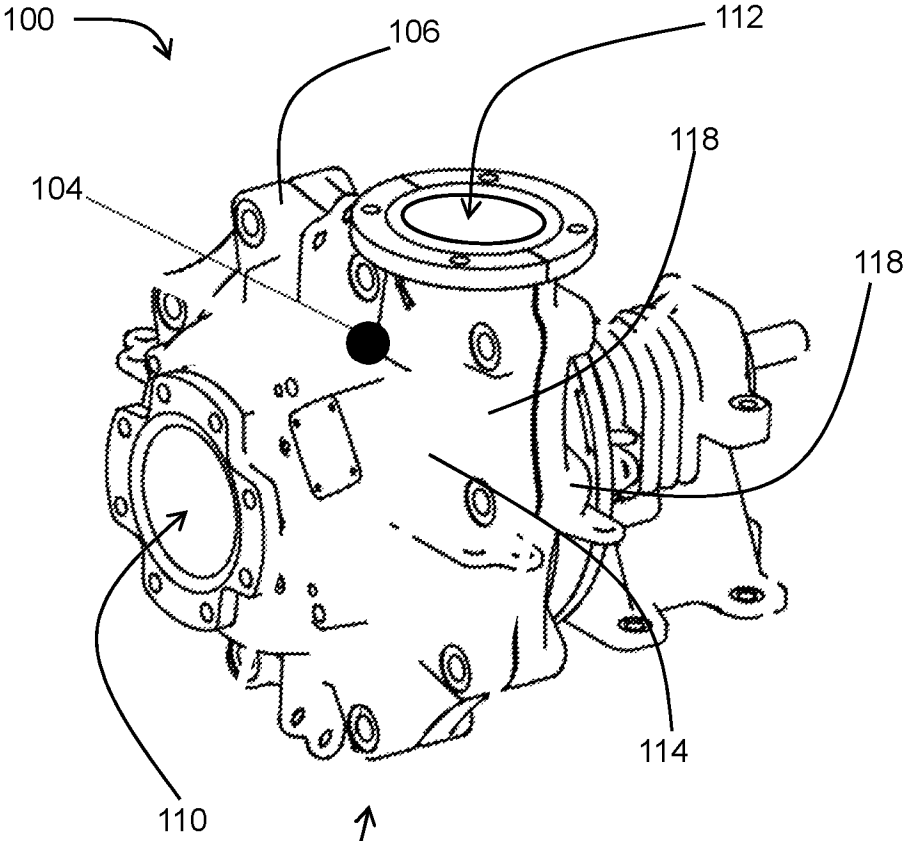
FIGS. 1A and 1B are a top and perspective view of a pump system.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arrange d, substituted, combined, separated and designed in a wide variety of different configurations, all of which are contemplated in this disclosure.

Referring firstly to FIGS. 1A, 1B, 1C and 1D, the pump system 100 comprises a pump 102 and a vibration sensor 104. The pump 102 is a centrifugal (e.g. slurry) pump and comprises a pump casing 106 defining a pump chamber 108 (see, in particular, FIGS. 1C and 1D), an inlet 110 for receipt of flowable material (e.g. slurry) into the chamber 108, and an outlet 112 for discharge of flowable material from the chamber 108. Although not shown in the present figures, the pump 102 also comprises an impeller that is disposed within the pump chamber 108 and that is rotatably mounted so as to accelerate flowable material (in order to pump the flowable material) in use.

Figure 1A:
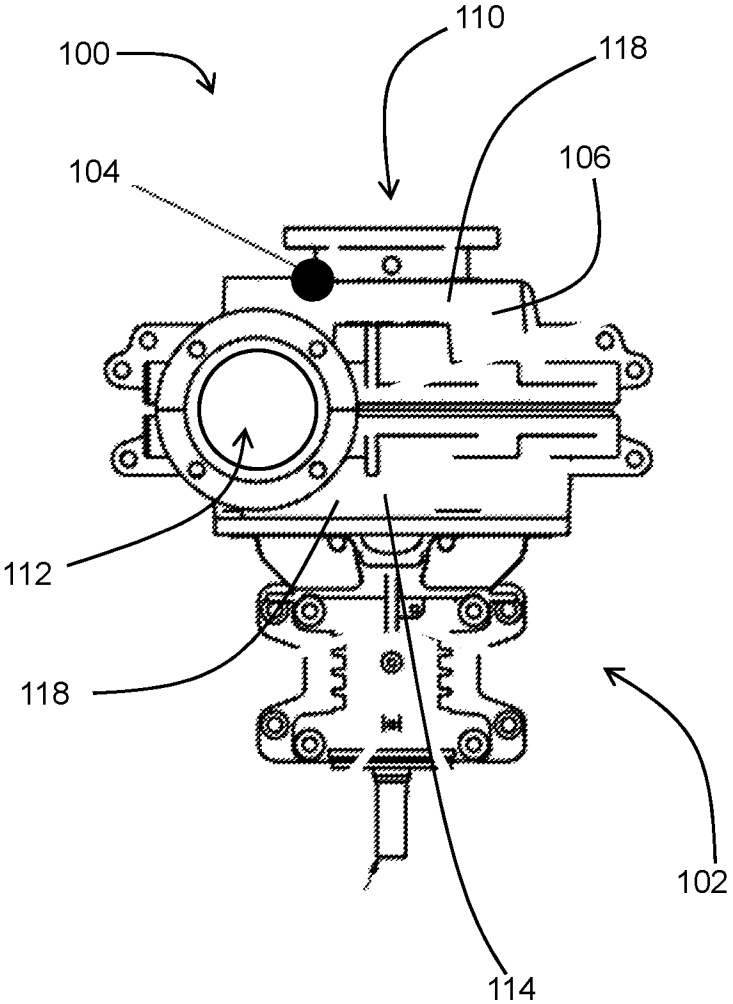
Figures 1C, 1D:
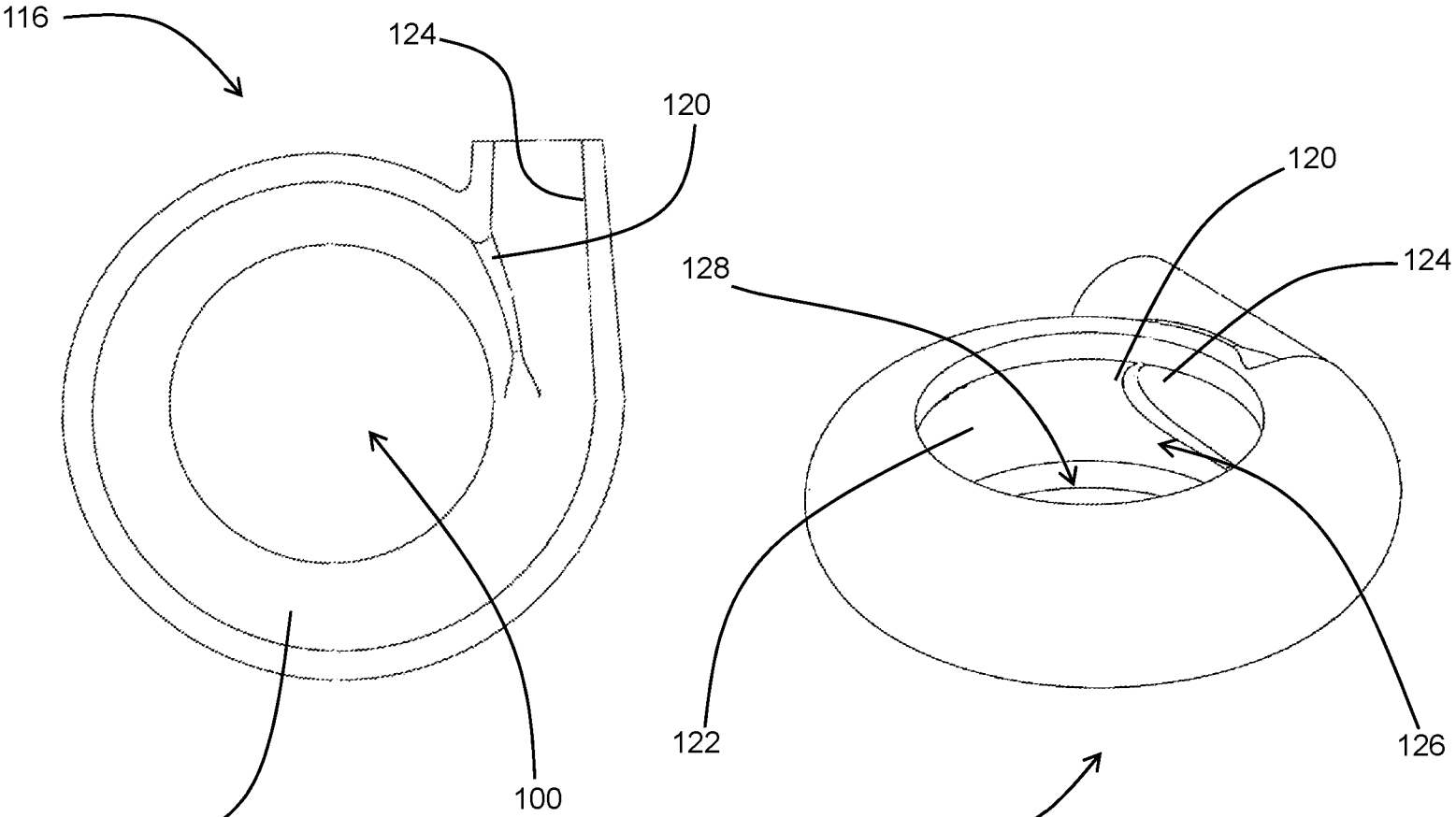
FIGS. 1C and 1D are a section and perspective view of a pump liner forming part of the pump system of FIGS. 1A and 1B.

The pump casing 106 comprises an external housing 114 and an internal pump liner 116 (shown in more detail in FIGS. 1A and 1B). The external housing 114 is formed of two shell structures 118 secured to one another so as to form a cavity therebetween. The internal surfaces of this external housing 114 (i.e. within the cavity) are lined by the pump liner 116, such that the pump liner 116 defines the pump chamber 108. The external housing 114 may be formed of e.g. a hard metal such as cast white iron, and the liner 116 may be formed of e.g. an elastomeric material such as rubber.

In other forms the pump casing may not comprise a liner (also known as an unlined pump), and instead the internal surfaces of the external housing may define the pump chamber. Unlined pumps may be particularly suited to low wear situations—for example, where the flowable material is a liquid or a non-abrasive solid-liquid mixture.

In the illustrated embodiment, a vibration sensor 104 is mounted to the pump casing 106—in particular, on the external housing 114—and is arranged in use to detect vibration of a transition region 120 of the pump 102. The location of this transition region 120 will be described in detail below with reference to FIGS. 1A and 1B.

The sensor 104 may be, for example, in the form of a single-axis or tri-axial accelerometer. In the illustrated embodiment the sensor 104 is mounted to an outer surface of the external housing 114 (forming part of the pump casing 106) via a mounting arrangement in the form of a threaded hole that is cast into the external housing 114.

Although not shown in the figures, the sensor may be connected (by wired or wireless connection) to a processor for processing vibration data. This wired or wireless connection may be direct or indirect. For example, the sensor may transmit data to a network device mounted on the pump that may, in turn, transmit that data to a central processor (that may serve multiple machines).

FIGS. 1A and 1B depict the pump liner 116 that forms part of the casing 106 of the pump 102 and that lines the internal surfaces of the external housing 114.

The pump liner 116 comprises a pump chamber inner peripheral surface 122 that defines the pump chamber 108, an outlet inner peripheral surface 124 that defines the outlet 112 of the pump, and the (previously introduced) transition region 120 that extends between the pump chamber surface 122 and the outlet surface 124. The pump chamber surface 122 may have a volute shape, offset circular shape or any other shape suitable for pumping a flowable material.

An inlet opening 126 is formed in a first side of the pump liner 116, and an opposing drive shaft opening 128 is formed in an opposite second side of the pump liner 116. In use, a rotatably mounted drive shaft is received through the drive shaft opening 128 and the impeller is mounted to the drive shaft so as to be disposed within the pump chamber 108. Flowable material enters the pump chamber 108 through the inlet opening 126 and is moved within the pump chamber 108 by the impeller. Due to the shape of the vanes of the impeller, this movement is generally in the form of a radially outward acceleration of the flowable material. In other words, the flowable material is caused to spiral outward toward the pump chamber surface 122. Hence, some of the flowable material may exit the pump chamber 108 via the outlet 112 (which is positioned generally tangentially to the pump chamber 108), whilst some flowable material recirculates within the pump chamber 108. The shape and positioning of the transition region 120 is such that it diverts flowable material (that has been accelerated by the impeller) into the outlet 112. That is, the transition region 120 extends into the pump chamber 108 such that it 'cuts off' a portion of the flowable material recirculating within the pump chamber 108. This diversion of flowable material through the outlet 112 helps to minimise recirculation of the flowable material within the pump chamber 108.

Due to its diversion function, the transition region 120 can be particularly susceptible to wear. For example, the pressure behind the transition region 120 (at the pump chamber 108 side) may differ from the pressure in front of the transition region 120 (at the outlet 112 side). This pressure differential may fluctuate as the distal ends of the vanes of the impeller pass by the transition region 120, which may cause pressure "pulses" in the fluid that vibrate the transition region and can result in damage to the transition region 120. The transition region 120 is also susceptible to wear caused by cavitation and impact of the flowable material on the transition region 120.

This wear, and/or the impact of this wear on the performance of the pump 102, is on example of a wear condition of the pump that can be detected based on the vibration of the transition region 120 using the present system (i.e. including the vibration sensor 104).

As should be apparent to the skilled person, because the pressure pulses are result of a vane passing the transition region, the pressure pulses generally occur in accordance with the vane pass frequency of the pump (i.e. the frequency at which a vane passes a given point in the rotation of the impeller). It has become apparent that changes in the vibration response, at the vane pass frequency, can be indicative of changes in performance and/or wear conditions of the pump. For example, a change in the vibration response of the pump at the vane pass frequency over time can be indicative of wear of the pump liner (e.g. at the transition region). Because the pressure pulses are caused by an interaction of the pump liner (or inner surface of the pump) and the impeller, such changes in the vibration can also be indicative of wear of the impeller.

Hence, using vibration data from the sensor, and information regarding the vane pass frequency of the pump, wear of the pump liner and/or impeller can be monitored. As is discussed above, the sensor may be in communication (i.e. directly or indirectly) with a processor. This process can be configured to perform an analysis which takes the vibration data as an input and provides an indication of a wear and/or performance condition of the pump. The process may alternatively, or additionally, involve wear or performance predictions (e.g. so as to allow replacement of components before those components fail).

Figure 2:
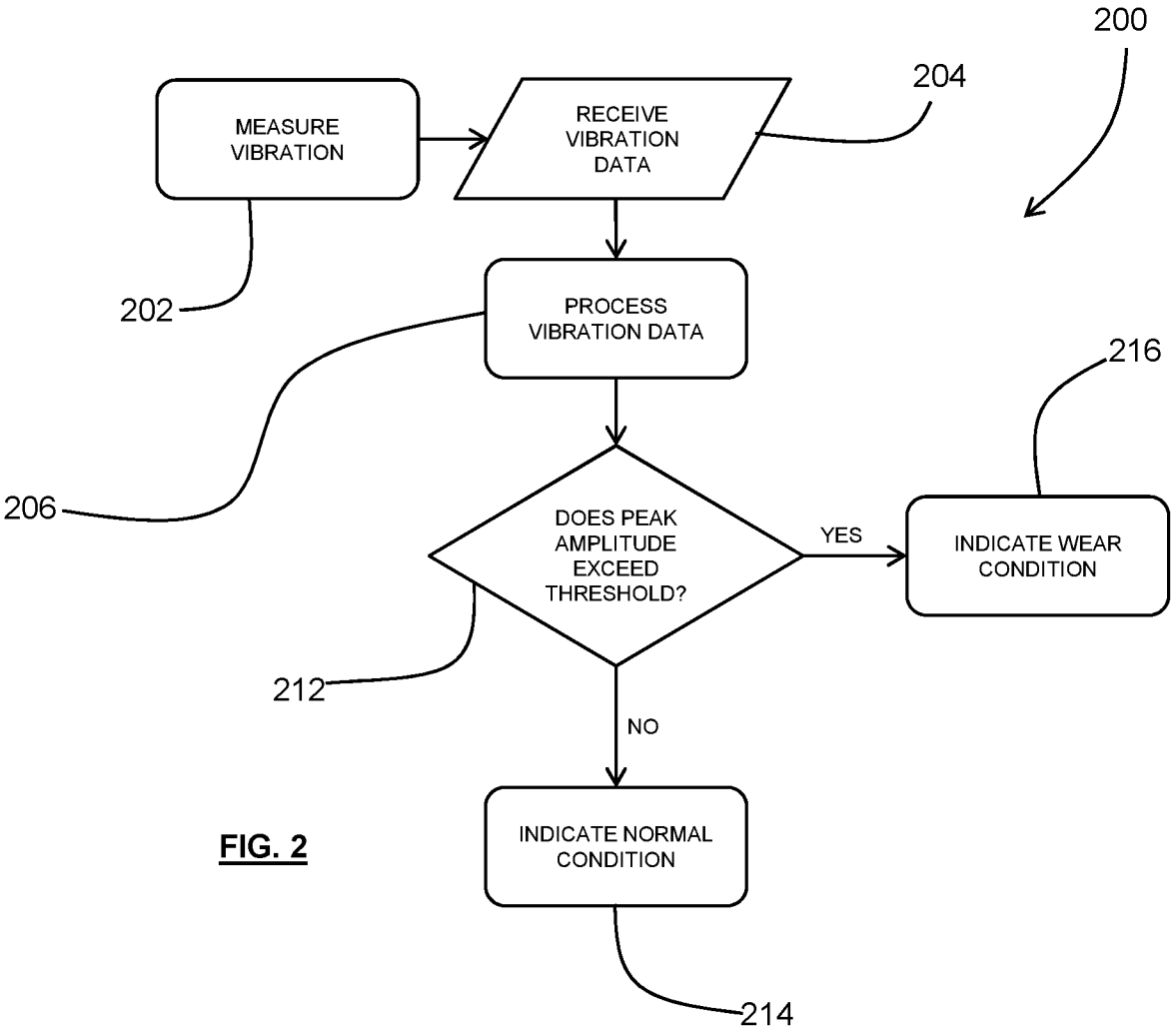
FIG. 2 is a flow chart depicting a first embodiment of a method for detecting a condition of a pump.

FIG. 2 illustrates an exemplary method 200 of indicating an overall condition of a pump, for example, using the system 100 as described above. The method 200 comprises detecting vibration 202 in at least one region of the pump and obtaining the vibration data 204 from the measured vibration. The measured vibration data is, in particular, indicative of the vibration at the transition region of the pump (i.e. which diverts fluid from the pump chamber to the outlet). The method also comprises analysing 206 the vibration data to indicate a wear or performance Once the vibration data is received, it is processed 206. In general, the vibration data is received 204 in a continuous manner and processed 206 in a real-time continuous manner. However, it can alternatively be received 204 and processed 206 at predetermined intervals (i.e. to periodically check the condition of the pump), or can be processed on-demand (i.e. manually).

The processing 206 of the vibration data can take various forms—for example, the processing may be a determination of the instantaneous amplitude of the vibration at the transition region. Alternatively, the processing may be in the form of a calculation of the root mean square (RMS) amplitude (e.g. over a predetermined time period) of the vibration.

Once processed, the instantaneous amplitude or RMS can then be tested against a predetermined threshold amplitude (or threshold RMS amplitude). If the measured amplitude 212 of vibration within the frequency range doesn't exceed the predetermined threshold amplitude, a normal condition is indicated 214 (i.e. signifying that the pump is operating normally). On the other hand, when the amplitude does exceed the threshold amplitude, a wear condition is indicated 216 (i.e. signifying that the health of the pump is unsatisfactory). The predetermined threshold is different between pump types, installation conditions and various other factors. Hence, it may be determined using historical or experimental data (e.g. for particular pump and installation types).

The indication of a wear condition may, for example, be in the form of an alert signal to a controller, or a displayed alert (e.g. alert light or message on a display, etc.) to an operator. In either case, the alert may result in a control response, such as an adjustment in the operating parameters of the pump, or in ceased operation of the pump. Alternatively, an alert may simply prompt a visual inspection of the pump components by an operator (e.g. in person or by way of a camera) to consider whether replacement is required. On the other hand, an indication of normal operation does not require action to be taken—instead, the (i.e. until the amplitude does exceed the threshold amplitude and an alert is created).

Figure 3:
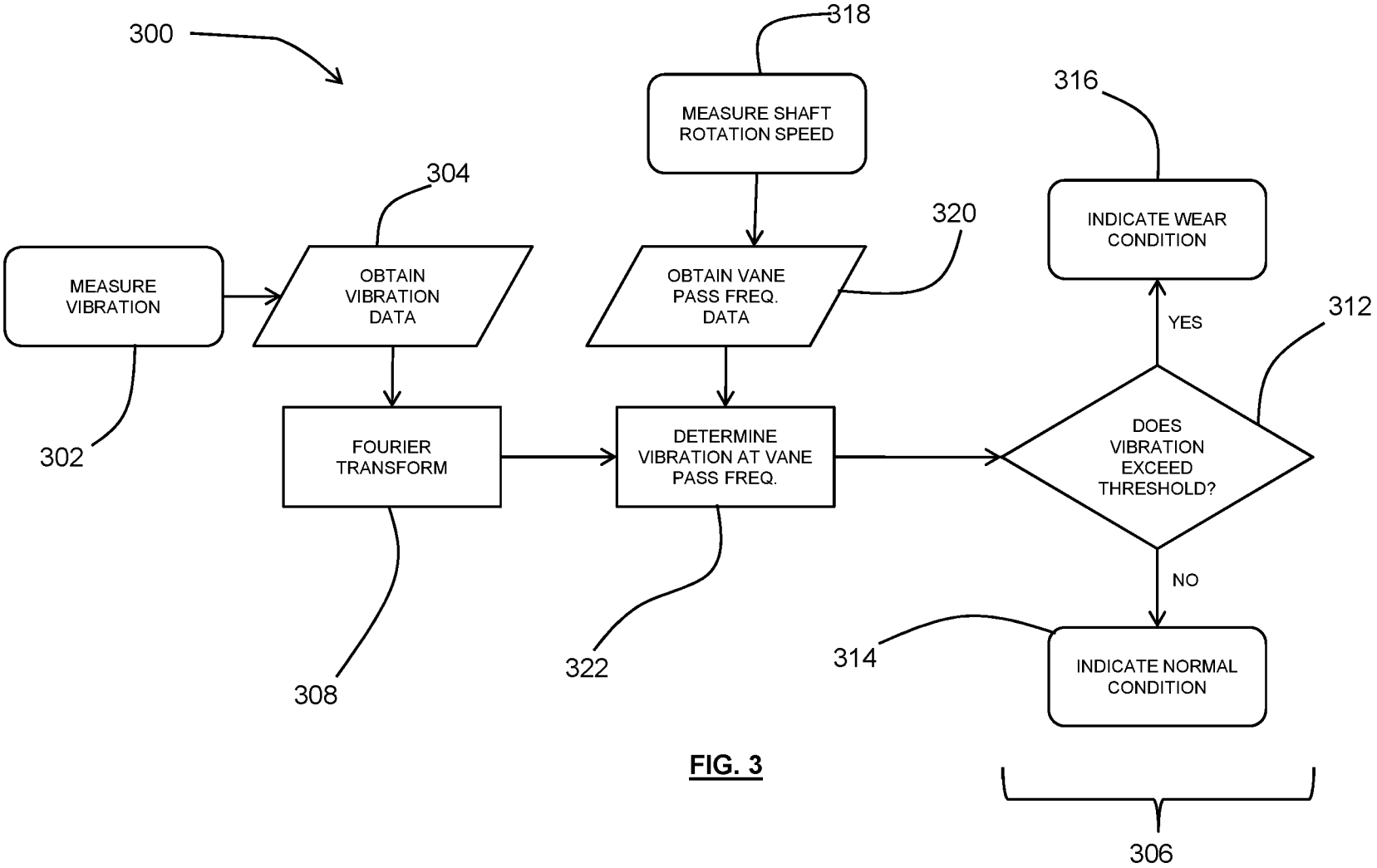
FIG. 3 is a flow chart depicting a second embodiment of a method for detecting a condition of a pump.

FIG. 3 depicts a further method 300 for detecting a condition of a pump. The method 300, again, comprises measuring vibration 302, obtaining vibration data 304, processing that data 308, 322, and making a determination based on the data 306. As part of the processing of the data, the presently described method 300, additionally (i.e. to the previously described embodiment) comprises decomposing the vibration data into its constituent frequencies. The presently described method may, for example, be useful in determining wear of a rubber liner in a pump or a pump impeller.

The vibration data that is detected 302 by the vibration sensor (and that is received 304 for processing 308, 322) generally incorporates a range of frequencies. In the present method, the processing of the vibration data comprises monitoring or isolating a predetermined range or sample of frequencies within this range of frequencies. In order to do so, the vibration data that is received from a vibration sensor mounted to the pump is decomposed (e.g. via a Fourier transform operation) into its constituent frequencies 308. A range of these frequencies is then selected or isolated as part of the analysis of the data 322. As should be apparent to the skilled person, in practice the choice of which frequencies to sample is dependent on, among other factors, pump type, installation, sensor location and the performance or wear condition that is to be determined. Historical data (or experimental data) from similar pumps and/or similar installations may be used to inform this selection.

As has already been discussed, one frequency that can be of particular interest is the vane pass frequency of the pump. In the illustrated method 300 the selected range of frequencies correspond to the vane pass frequency of the pump, but in other embodiments different frequency ranges may be chosen, depending on the desired outcome. As has also been discussed above, the passing of the impeller vanes across the transition region results in a pulse, that causes vibration of the transition region. As the transition region and/or the impeller wear, the vibration of the transition region, caused by the passing of the impeller vanes, changes. In other words, there can be a relationship between impeller and/or pump liner wear and the amplitude of the transition region vibration at the vane pass frequency. Hence, monitoring the amplitude of the vibration of the transition region at the vane pass frequency can facilitate detection of wear of the impeller and/or pump liner (e.g. at the transition region, where it is particularly susceptible to wear).

As should be apparent to the skilled person, the vane pass frequency depends on the configuration of the impeller and the rotation speed of the impeller. Thus, in order to accurately select the vane pass frequency, the rotation speed of the drive shaft (driving the impeller) is measured 318 as part of the process. This measurement is converted into the vane pass frequency using known dimensions of the impeller 320, and can then be used to isolate appropriate vibration data (subsequent to it being processed using a Fourier transform (e.g. FFT)).

In the present method, rather than isolate the vane pass frequency alone, a range of frequencies is selected that incorporates the vane pass frequency 322. This ensures that vibrations above and below the vane pass frequency (but close to the vane pass frequency) are also captured. In order to monitor for a wear condition, the (maximum) amplitude of the vibration in the selected frequency range is determined 322. Alternatively, a root mean square (RMS) of the amplitude of the vibration, across the selected range of frequencies, may be determined. In either case, the determined value can be compared 312 to a predetermined threshold value in order to indicate a normal condition 314 or wear condition 316 of the pump. In some cases, however, the instantaneous vibration data alone may not be sufficient to provide the desired information on the wear of the pump. In such cases, a trend in vibration data may instead be useful in determining whether the pump is operating under normal conditions or whether one or more components of the pump are worn. For example, vibration data can be stored as it is received, and new data can be compared with existing data to determine whether changes occur in the vibration data over time. Various changes may indicate a performance or wear condition of the pump.

As previously discussed, depending on the chosen frequencies, and the location of the sensor, the wear condition that is indicated may e.g. be wear of the pump liner (such as at the transition region), wear of the impeller, or wear of various other components of the pump. As will be described further below in the "Example" section it has become apparent that vibration intensity (i.e. amplitude) at the transition region can correlate with wear of the liner of the pump. In this way, the above method can be useful for determining wear of the liner of the pump.

The above described method 300 can also be modified to provide an indication of wear of other various components of the pump. For example, it has become apparent that, in some pumps, there is a relationship between vibration vane pass frequency, and multiples (i.e. harmonics) of the vane pass frequency, and impeller wear. This relationship can largely depend on sensor location and pump type, and a test against a predetermined threshold (as used above) may not be the most effective manner for determining whether a component of a pump is worn. Instead, a comparison can be made of the vibration signature (i.e. vibration data split into its frequencies) with a database of historical vibration signatures in order to classify the vibration signature as one that is indicative of a particular wear condition, or of a normal operating condition.

This classification process may be performed by way of a machine learning algorithm (e.g. random forest, logistic regression, support vector machine, artificial neural networks, etc.). For example, the machine learning algorithm may be trained on a set of historical pump data (e.g. collected using the above described methods and system) that includes transition region vibration data signatures and, optionally, information regarding the pump and installation type. The machine learning algorithm may be supervised (i.e. by providing, with the signatures, a known wear condition) or unsupervised. The algorithm can then predict, based on the received vibration signature, a wear condition (or performance condition) of the pump.

The above described methods may be performed by a processor in communication with the sensor or sensors of the system. In this respect, the data received from the sensors, and the data produced by transformation of that data, can be stored by a memory in communication with the processor (e.g. by way of a communication bus). The processor may interface with a control system, which may respond in an appropriate manner to the indication of the condition of the pump. Alternatively or additionally, the processor may be in communication with an I/O device, such as a display or an alert light in order to indicate the pump condition to an operator.

EXPERIMENTAL DATA

Example 1

Figure 4:
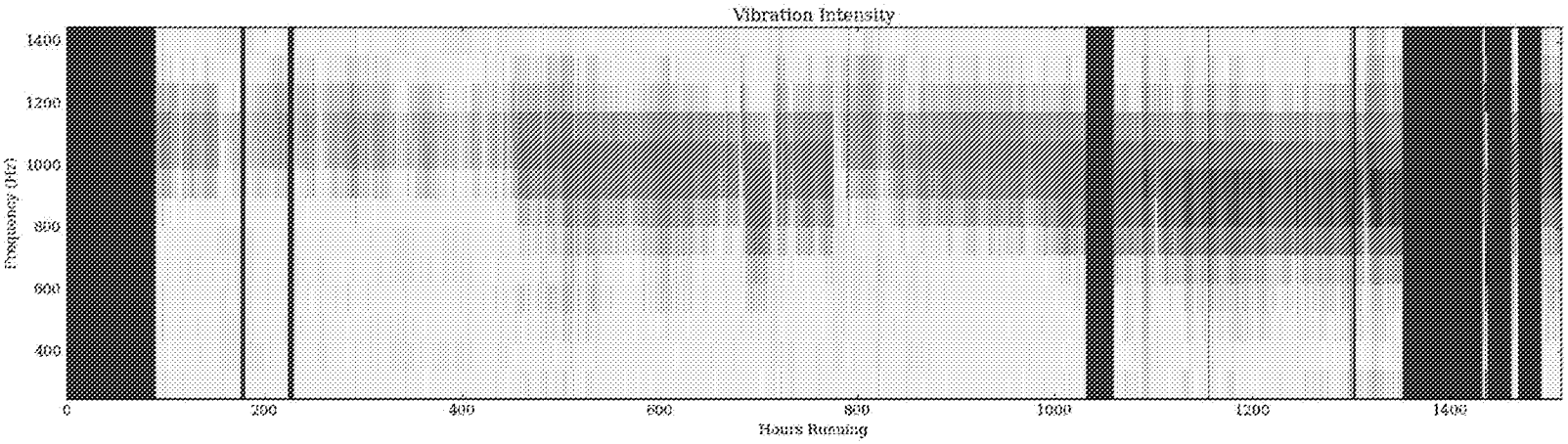
FIG. 4 is a chart depicting the vibration data measured by a pump system.

FIG. 4 provides an example of the vibration data that is indicative of vibration of the transition region of a centrifugal pump. This data was produced using a vibration sensor mounted to the external housing of a centrifugal slurry pump in proximity to the transition region (e.g. within two outlet diameters of the transition region). In particular, the vibration sensor was mounted to the external housing of the pump by way of an intermediate magnetic mounting plate. The mounting plate was secured to the surface via adhesive, and the sensor was removably mounted thereto by magnetic attraction.

As is apparent from this vibration data, the vibration intensity at a frequency of approximately 1000 Hz increased as the pump was operated over time. The vibration intensity at frequencies surrounding 1000 Hz also increased over time. This generally corresponded to wear of the pump over time. Hence, monitoring this data may enable an indication of the condition of the pump, and may allow estimation of when the pump, or a component of the pump, requires replacement.

Example 2

Figure 5B:
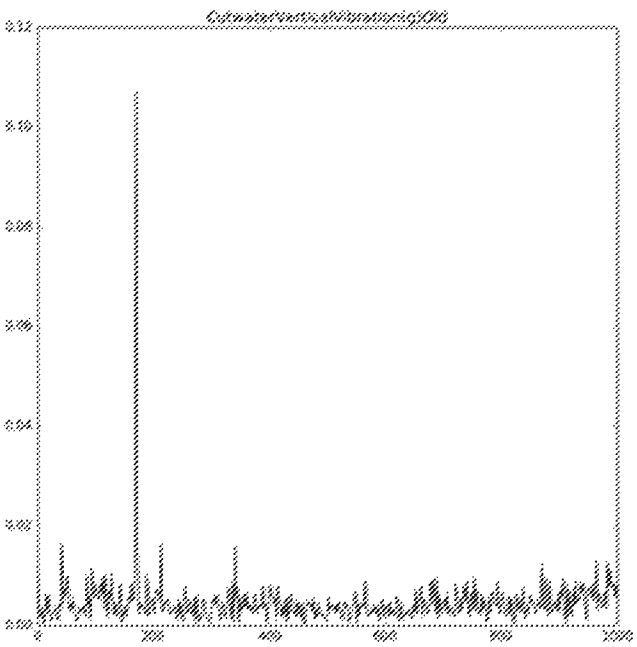
FIGS. 5A and 5B are charts depicting vibration data measured by a pump system.
Figure 5A:
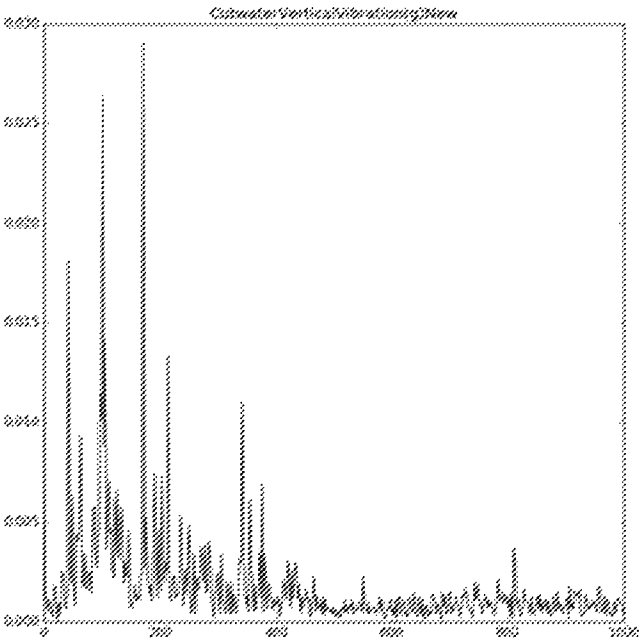

FIGS. 5A and 5B illustrate vibration signatures for a metal lined centrifugal pump. Like the above described data, this data was produced using a vibration sensor mounted to the external housing of a metal lined centrifugal slurry pump in proximity to the transition region (e.g. within two outlet diameters of the transition region). In particular, the vibration sensor, which was in the form of a single-axis accelerometer, was mounted to the external housing of the pump by way of an intermediate magnetic mounting plate. The mounting plate was secured to the surface via adhesive, and the sensor was removably mounted thereto by magnetic attraction.

The vibration data received from the accelerometers was processed using an FFT analysis in order to split the vibration signal into its constituent frequencies (i.e. so as to provide a vibration signature). The vibration signature shown in FIG. 5A is taken from a point in time when the impeller in the pump had recently been replaced (i.e. the impeller was considered to be a 'new' impeller). The vibration signature shown in FIG. 5B is taken from a point in time when the impeller in the pump was nearing the end of its useful life (i.e. the impeller was significantly worn and was considered to be an 'old' impeller).

As is apparent from the figures, the vibration signature for the 'new' impeller includes vibration around the vane pass frequency of the pump (approximately 180 Hz), or the fundamental frequency, and around the second harmonic of the fundamental frequency (i.e. twice the frequency of the vane pass frequency).

The vibration signature for the 'old' impeller also includes vibration around the vane pass frequency of the pump (approximately 180 Hz), and around the second harmonic of the fundamental frequency. However, in this vibration signature, the amplitude of the vibration at the vane pass frequency has significantly increased. The vibration signature at the second harmonic frequency has not increased significantly.

Hence, the fundamental frequency (alone) may be used to determine wear of the pump impeller, or the ration of the fundamental frequency to the second harmonic frequency may be used. In response to the illustrated results, the impeller of the pump may be replaced to avoid catastrophic failure of the pump and/or to avoid detrimental performance issues.

Example 3

Figure 6B:
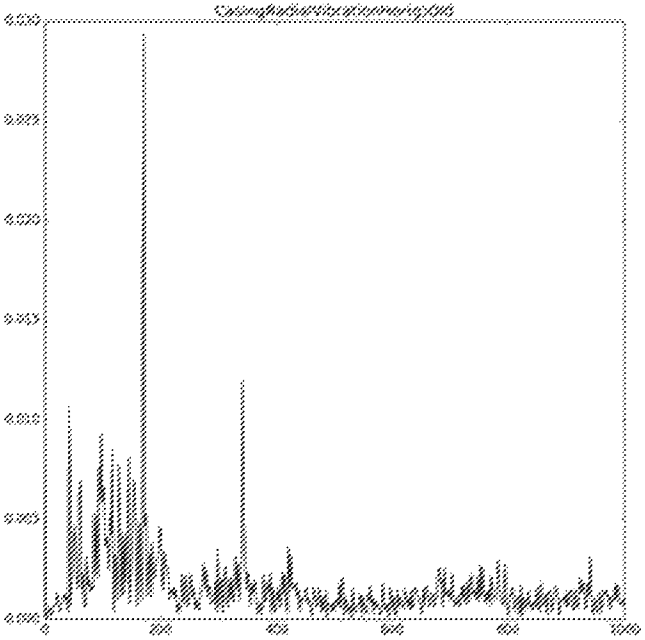
FIGS. 6A and 6B are charts depicting vibration data measured by a pump system.
Figure 6A:
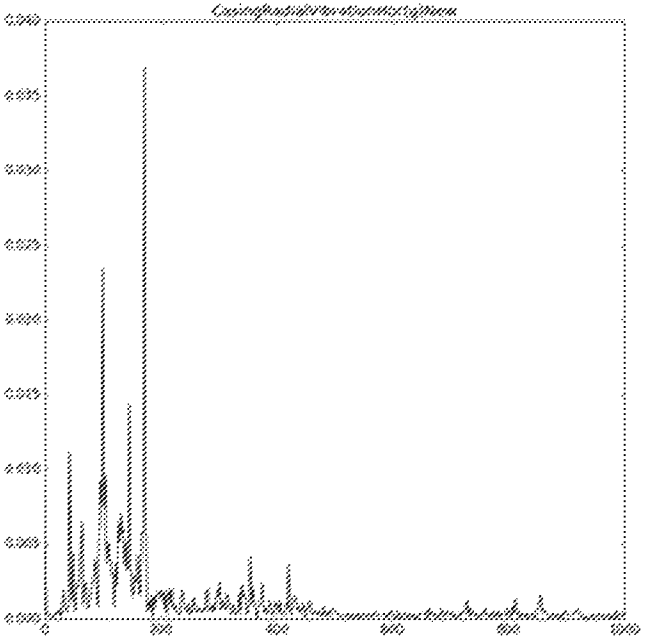

FIGS. 6A and 6B illustrate further vibration signatures for a metal lined centrifugal pump. This data was again produced using a vibration sensor mounted to the external housing of a metal lined centrifugal slurry pump, but on a position on the casing that was further away from the transition region than that used for the data shown in FIGS. 5A and 5B. The vibration sensor, which was again in the form of a single-axis accelerometer, was mounted to the external housing of the pump by way of an intermediate magnetic mounting plate. The mounting plate was secured to the surface via adhesive, and the sensor was removably mounted thereto by magnetic attraction.

Unlike the previously described vibration signatures, the amplitude of the fundamental frequency of the vibration signature in the presently described figures does not change significantly between the new impeller and the old impeller. However, there is a significant increase in the amplitude of the second harmonic of the fundamental frequency from the new impeller to the old impeller. This result shows that both fundamental frequency and harmonics of the fundamental frequency can provide an indication of impeller wear.

Variations and modifications may be made to the parts previously described without departing from the spirit or ambit of the disclosure.

For example the way in which the sensor is mounted to the pump may differ. For example, a magnetic mounting plate may be secured to the pump, and the sensor may be removably secured to the magnetic mounting plate.

Similarly, the system may make use of multiple sensors and the vibration data from those sensors may be combined to provide any indication of a condition of the pump.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A pump system comprising:

a pump comprising:

a pump casing defining a pump chamber;

an inlet for receipt of flowable material into the chamber;

an outlet for discharge of flowable material from the chamber;

an impeller disposed within the pump chamber to accelerate flowable material within the pump chamber; and a transition region extending between an inner peripheral surface of the pump chamber and an inner peripheral surface of the outlet, the transition region configured in use to divert flowable material, accelerated by the impeller, to the outlet; and a vibration sensor mounted to the pump casing and arranged in use to detect isolated vibration of the transition region along an axis that extends relative to a rotational axis of the pump; and a processor configured to:

receive the isolated vibration data, indicative of vibration at the transition region, from the vibration sensor; and process the isolated vibration data to determine, based on vibration at the transition region, a wear or performance condition of the pump.

2. The system according to claim 1 wherein the outlet defines an internal outlet diameter, the vibration sensor being mounted to the housing at a distance from the transition region that is less than two outlet diameters.

3. The system according to claim 1 wherein the vibration sensor is an accelerometer.

4. The system according to claim 1 wherein the axis that the vibration sensor detects vibration along extends generally radially relative to the rotational axis of the pump.

5. The system according to claim 1 wherein the axis that the vibration sensor detects vibration along extends generally circumferentially relative to the rotational axis of the pump.

6. The system according to claim 1 wherein the pump casing comprises an internal pump liner defining the pump chamber, and the sensor is mounted so as to be at least partially embedded within the pump liner.

7. A The system according to claim 1 further comprising a controller to control the pump in response to the determined wear or performance condition of the pump.

8. A The system according to claim 1 wherein the processor is configured to determine a wear or performance condition of the pump based on a selection of the isolated vibration data corresponding to the vane pass frequency of the pump.

9. A The system according to claim 8, wherein the processor is configured to determine a wear or performance condition of the pump based on changes, over time, in the isolated vibration data corresponding to the vane pass frequency of the pump.

10. A The system according to claim 1 wherein the processor is configured to analyse the isolated vibration data against historical vibration data to classify the isolated vibration data as being representative of a pump having a particular performance or wear condition.

11. A method of detecting a condition of a pump as defined in claim 1, the method comprising:

detecting isolated vibration of the transition region of the pump along said axis that extends relative to the rotational axis of the pump;

obtaining the isolated vibration data from the measured isolated vibration, the isolated vibration data indicative of the vibration of the transition region of the pump; and analysing the isolated vibration data to determine a wear or performance condition of the pump.

12. The method according to claim 11 comprising analysing a predetermined range of frequencies of the isolated vibration data to indicate a wear or performance condition of the pump.

13. The method according to claim 12 wherein the predetermined range of frequencies generally corresponds to a vane pass frequency of the pump or a multiple of that vane pass frequency.

14. The method according to claim 12 wherein the range of frequencies comprises one or more 10 Hz wide frequency bands comprising the vane pass frequency and/or one or more multiples of the vane pass frequency.

15. The method according to claim 12 further comprising the step of determining whether the amplitude of the vibration within the predetermined range of frequencies exceeds a predetermined threshold amplitude.

16. The method according to claim 12 comprising the step of monitoring the predetermined range of frequencies for a change in amplitude over time.

17. The method according to claim 11 comprising calculating the root mean square of a sample of the vibration data and determining if the calculated root mean square exceeds a predetermined threshold root mean square value.

18. The method according to claim 11 wherein the wear or performance condition is wear at the transition region and/or wear of the impeller of the pump.

19. A The method according to claim 11 wherein the vibration is detected using an accelerometer.

20. A The method according to claim 11 comprising analysing the vibration data, such as by using a machine learning algorithm, against historical vibration data to classify the vibration data as being representative of a pump having a particular performance or wear condition.

* * * * *